US006045405A

United States Patent [19]

Geltsch et al.

[11] Patent Number: 6,045,405

[45] Date of Patent: Apr. 4, 2000

[54] SENSOR CONNECTOR

[75] Inventors: Hans-Otto Geltsch, Dreieich-Offenthal; Gheorghe Hotea, Griesheim; Fritz Josef Alois Kourimsky, Bensheim; Robert Neuhauser, Bruckberg; Walter Benedikt; Matthias Kuesell, both of Kornwestheim, all of Germany

[73] Assignees: The Whitaker Corporation, Wilmington, Del.; Robert Bosch GmbH, Stuttgart; Lisa Draxlmaier GmbH, Bilsbiburg, both of Germany

[21] Appl. No.: 08/875,287

[22] PCT Filed: Feb. 9, 1996

[86] PCT No.: PCT/IB96/00105

§ 371 Date: Jul. 22, 1997

§ 102(e) Date: Jul. 22, 1997

[87] PCT Pub. No.: WO96/24966

PCT Pub. Date: Aug. 15, 1996

[30] Foreign Application Priority Data

Feb. 10, 1995 [GB] United Kingdom ..... 9502590

[51] Int. Cl.[7] ..... H01R 13/66

[52] U.S. Cl. ..... 439/620; 439/607

[58] Field of Search ..... 439/620, 608, 439/610

[56] References Cited

U.S. PATENT DOCUMENTS

| | | | |
|---|---|---|---|
| 5,124,880 | 6/1992 | Okamoto et al. | 361/306 |
| 5,246,389 | 9/1993 | Briones | 439/620 |
| 5,769,667 | 6/1998 | Belopolsky | 439/620 |

FOREIGN PATENT DOCUMENTS

| | | | |
|---|---|---|---|
| 3416905 | 1/1986 | Germany | 439/620 |
| 43 11 639-A1 | 10/1994 | Germany | H01R 9/09 |
| 2 274 026 | 7/1994 | United Kingdom | H01R 13/506 |

OTHER PUBLICATIONS

PCT International Search Report (see PCT Publication).

*Primary Examiner*—Gary Paumen
*Assistant Examiner*—Antoine Ngandjui
*Attorney, Agent, or Firm*—Driscoll Nina

[57] ABSTRACT

A sensor connector comprises a conductive outer housing within which is mounted a certain length of shielded able connected to receptacle terminals that receive pins of a sensor. A shield element extends across the inside of the outer housing to provide a shield means between the sensor and the cable leads which, in one embodiment, is stamped and formed, and in another embodiment is a printed circuit board with a ground plane on one side and surface mounted capacitors on the other side interconnected to the terminals for filtering the signal.

23 Claims, 3 Drawing Sheets

SENSOR CONNECTOR

BACKGROUND OF THE INVENTION

1. Field of the Invention

This invention relates to an electrical connector for coupling to a sensor for example a sensor mounted in a combustion chamber the connector being resistant to shock and electrostatic and electrormangnetic interference.

2. Summary of the Prior Art

In the automotve industry, pressure sensors have been developed for positioning in combustion chambers of combustion engines to determine the combustion characteristics (pressure over time) of the ignited fuel within the piston chamber. Such sensors might comprise a piezo electrical device for measuring the pressure variations, or other electrically driven pressure sensors, which thus need to be supplied with leads for electrical power and signal transmission. Due to the high electrostatic and electromagnetic interference generated by ignition of the spark in the piston chamber, the signal leads need to be protected from this interference by shielding and possibly filtering. A further problem are the high shocks generated by the combustion. The connector must be able to withstand the shocks over the specified life of the combustion engine whilst making reliable connection with the sensor. Other sensors for use in an automobile or other types or vehicles may of course also be subject to mechanical shock, thermal solicitation, and electronmagnetic noise.

SUMMARY OF THE INVENTION

An electrical connector for mounting on a printed circuit board is known from DE-A-43 116 39. The connector includes an insulating body in which at least one contact is arranged. The connector further includes a shield member which has apertures for terminals which project through the shield member. The shield member may also be the ground contact element which is arranged on or in the insulating body. A filter arrangement may be used.

It is an object of this invention to provide a sensor connect that provides a reliable connetion to a sensor subject to mechanical or thermal shock, and electromagenetic interference e.g. a sensor mounted in an automobile, in a cost-effective manner.

It is a further object of this invention to provide a sensor connector that protects the signal leads leading to the sensor from excessive electromagnetic and electrostatic interference or example generated by spark ignition, and furthermore a connector that can withstand the shocks for example generated by a combustion engine over the required lifetime of the engine.

The objects of this invention have been achieved by providing a sensor connector comprising an outer housing having a cavity extending therethrough, and a connection section mounted therein that has an insulative housing and terminals for connection to leads of a sensor cable, further comprising a conductive shield member mounted transversely to the passage of the cavity and extending substantially fully thereacross except for around the terminals which project past the shield member.

In one embodiment, the shield member could be a stamped and formed plate that is overmoulded by the housing, or securely fixed thereto. The inner housing may be fully received within the outer housing, the inner housing comprising cavities for receiving receptacle contact portions of the terminals for electrical contact with pin contacts of the sensor. The contact portions may be integral with an insulation displacement contact (IDC) connection portion for contacting the sensor leads, the housing having a plurality of slots extending substantially parallel to each other from an outer surface of the housing to the IDC connection sections to allow stuffing of the leads into the IDC sections therethrough.

The terminals could further comprise additional contact legs extending therefrom for electrical contact to a pole of a capacitor or another filter element, the other pole of the filter element electrically connected to the shield member.

In another embodiment, the shield member could be formed by conductive material covering a printed circuit board, the board also having circuit traces for interconnecting the terminals to the filter elements which could, for example, be surface mounted to the printed circuit board. A stamped and formed metal clip having spring arms could be mounted to the printed circuit board for electrical contact with the outer housing (which is electrically connected to ground). The outer housing would thus be an electrical conductor, for example a metal, which is electrically connected to conductive shielding of the cable at a cable receiving end. Such cable may have a drain wire, which could be electrically connected to the outer housing by overmoulding an end portion of the cable beyond which the leads extend with a conductive material, for example a conductive plastic material that is easy to mould. The outer housing could be provided to extend along a certain length of the cable and the space therebetween injected with a plastic or elastomeric material to securely attach the cable to the outer housing to provide sufficient strain relief for axial and bending forces on the wire.

Resistance to shock could be enhanced by tight abutment of the inner housing against the cable end overmouldings, and soldering of the filter elements to the shielding and the terminals.

DETAILED DESCRIPTION OF THE PREFERRED EMBODIMENT

Figure 1:
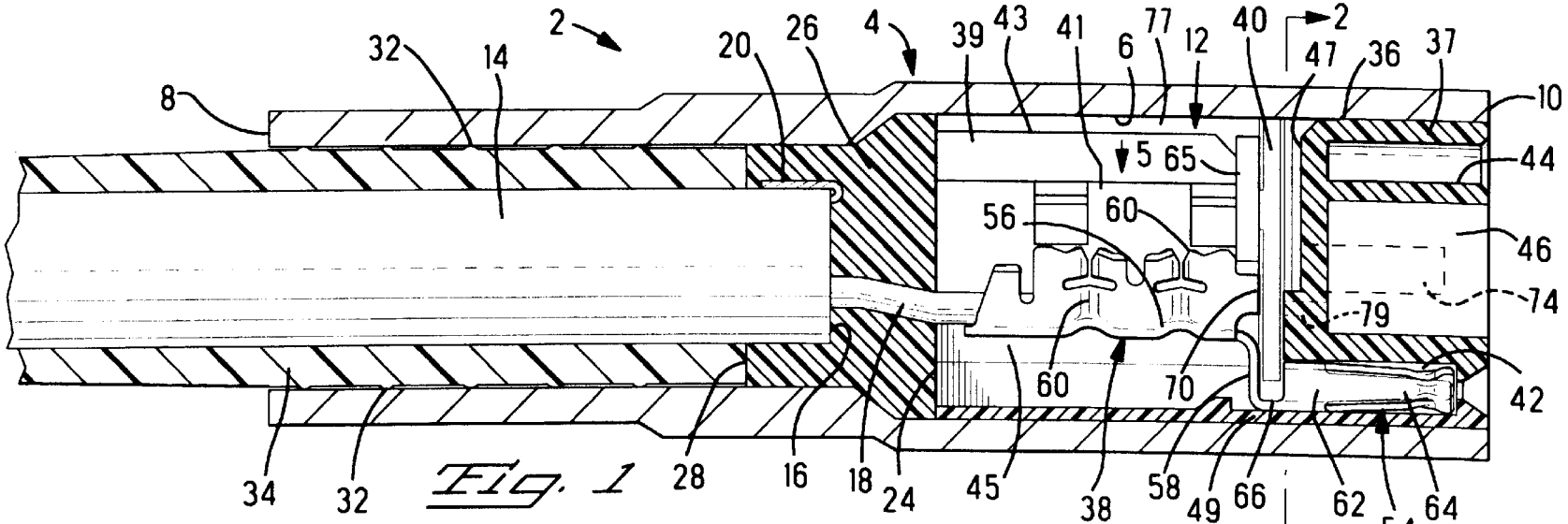
FIG. 1 is a cross-sectional view through a first embodiment of this invention.

Referring first to FIGS. 1–5, a sensor connector 2 comprises an outer housing 4 having a cavity 6 extending therethrough from a cable receiving end 8 to a sensor receiving end 10, and a connection section 12 positioned within the outer housing 4. The connection section 12 extends from the sensor end 10 to an intermediate position within the cavity 6.

A sensor cable 14 extends into the cavity 6 through the cable receiving end 8 to its end 16 proximate the connection section 12, where leads 18 of the cable 14 then continue into the connection section 12 for electrical connection therewith. The cable 14 has an outer insulative layer surrounding a conductive shielding that surrounds the plurality of leads 18 (in this case 3). In order to electrically connect the shielding of the cable to ground, a drain wire 20 is provided, and in this case folded back over the outside of the cable 14 from the end 16. A section of the cavity 6 from a cable end 24 of the connection section 12 to a position beyond the drain wire 20 is injection moulded with a conductive plastic material 26 that electrically interconnects the drain wire 20 (and therefore the cable shielding) to the outer housing which in this embodiment is made of metal and thus acts as shielding around the connector. The cable end overmoulding 26 also acts as a strain relief member to securely retain the cable to the outer housing. The outer housing 4 is connected to ground via a casing around the sensor which is connected for example to the engine block of the combustion chamber.

Extending from a rear end 28 of the conductive moulded section 26 is an elastomeric or other flexible tubular member 34 filling the space between the cable and the outer housing rear end that extends over a certain length of the cable. The surface of the tubular member 34 is provided with circumferential ribs 32 to seal against the housing 4. The tubular member 34 extends beyond the cable receiving end 8 out of the housing cavity 6 in order to stiffen and protect the cable from overbending which is most critical at the outlet of the housing 4. It would of course also be conceivable to provide the tubular member 34 in the same material as the grounding section 26 to simplify the moulding thereof, where the ribs 32 would enhance the electrical contact against the outer housing.

Figure 8:
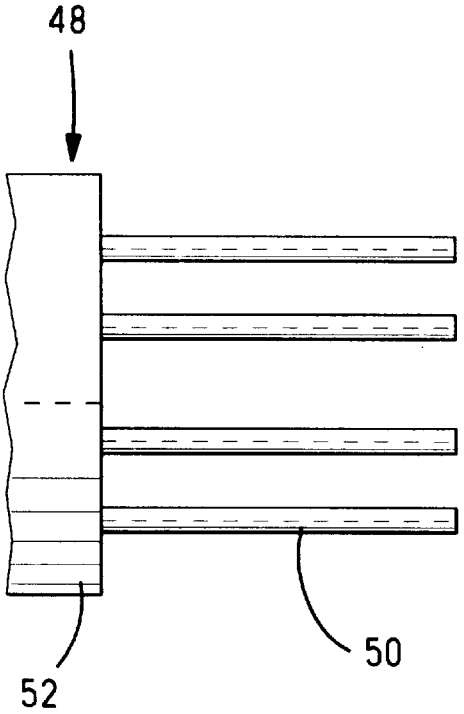
FIGS. 7 and 8 are respectively top and cross-sectional views of sensor contacts.
Figure 7:
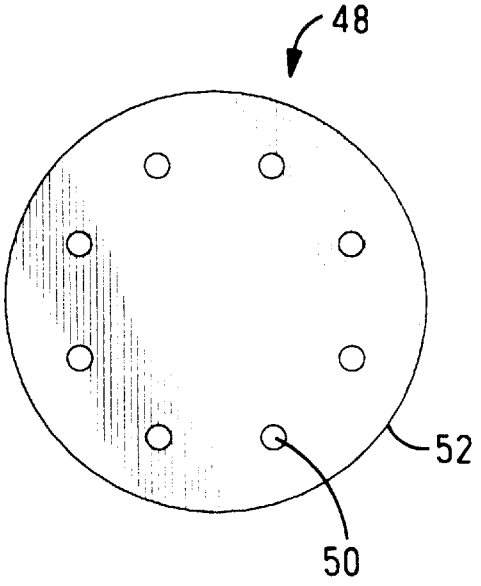

The connection section 12 comprises an insulative housing 36, a plurality of terminals 38 mounted in the housing 36, and a shield member 40. The housing 36 comprises a sensor receiving section 37 and a cable receiving section 39 on either side of the shield member 40. The insulative housing 36 comprises a plurality of receptacle contact receiving cavities 42 extending therein from the sensor end 10, and further sensor contact receiving cavities 44 also extending from the sensor end 10 therein, the cavities 42,44 disposed circumferentially around a central portion 46 of the housing 36. As can be seen in FIGS. 7 and 8, a connection end 48 of a sensor is shown comprising a plurality of pin contacts 50 disposed circumferentially around, proximate the outer surface 52 of the sensor. Only three of these pins are used for electrical connection to the cable 14, the other five pins being redundant and only used for calibration of the sensor prior to assembly to the connector 2. The vacant cavities 44 of the housing 36 thus are only for reception of the redundant pins, the three contact pins being inserted into the receptacle contact receiving cavities 42 for connection with the terminals 38.

The terminals 38 comprise a receptacle contact section 54 received within the housing cavities 42, attached to a lead connection section 56 via a transition strip 58. The terminal 38 is stamped and formed from sheet metal. The lead connection section 56 comprises insulation displacement contacts for connection to electrical strands of the leads by cutting through the lead outer insulation and contacting the inner strands. The insulation displacing contact (IDC) 60 thus cuts through the outer insulation when the lead 18 is stuffed in the direction of arrow S into the IDC contacts. Other known connection means such as crimping or soldering could of course be considered, however IDC connection provides a rapid and cost-effective solution.

Each receptacle contact 54 comprises a cylindrical base portion 62 which extends into two pairs of opposed contact arms 64 forming a pin receiving cavity to receive and contact the pin contacts 50 with four points of contact. The receptacle contact extends into the transition strip 58 proximate and along the outer housing 10 as it extends past the shield member 40 to allow the shield element to extend as far as possible across the cavity 6 for reasons that will be understood herebelow. The transition strip 58 is bent at a right angle and can thus act as a flexible member in the longitudinal direction of the outer housing for compensation thermal expansion/contraction of the various components to which the terminals are attached.

Figure 2:
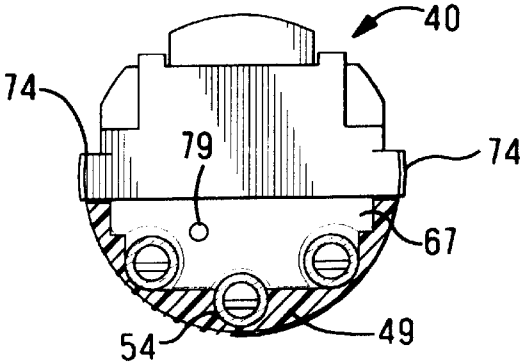
FIG. 2 is a cross-sectional view through lines 2—2 of FIG. 1.
Figure 3:
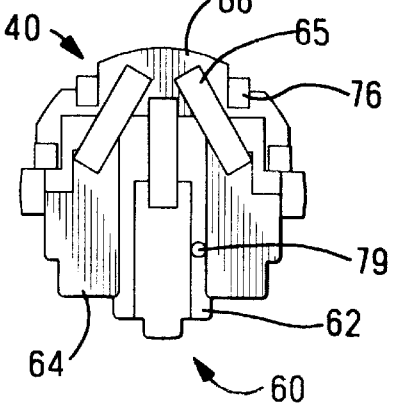
FIG. 3 is a bottom view of a shield and filter member.

The cable receiving section 39 of the housing 36 comprises slots extending from one side 43, the slots 41 each for receiving a connection section of the terminals 38 to allow passage of the wire therethrough for connection to the terminal. A base wall 45 of the slots 41 provides a seat for positioning of the terminal connection section thereagainst. Due to the transverse positioning of the shield member 40 across most of the cavity 6, the housing 36 comprises a slot 47 separating the sensor section 37 from the cable section 39 such that these two sections are connected together by a thin arc-shaped transition section 49 as best shown in FIG. 2.

Figure 4:
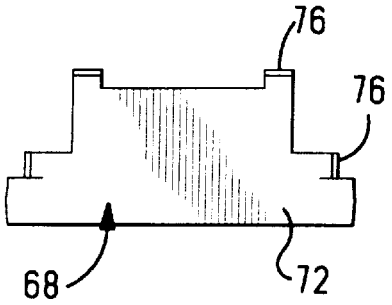
FIGS. 4 and 5 are respectively bottom and side views of a spring clip for interconnecting the shield member to ground.
Figure 5:
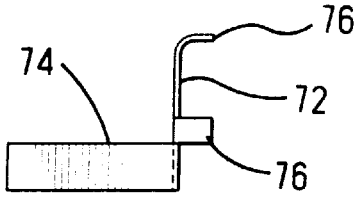

Referring now to FIGS. 4–5, the shield member will now be described. The shield member 40 comprises a printed circuit board 60 comprising a planar substrate 62, electrical circuit traces 64, surface mounted capacitors 65, a ground circuit trace 66 and a grounding clip 68. On a cable side (the side facing the cable 14) of the shield element 40, are positioned three conductive circuit traces 64 for electrically interconnecting the terminals 38 to one of the poles of the respective capacitors 65. The other pole of the capacitors 65 is electrically connected to the ground circuit trace 66. The terminal 38 is connected to the circuit traces 64 by tabs 70 that extend from the connection sections and abut the printed circuit board as shown in FIG. 1. The tab 70 and capacitors 65 are attached to the printed circuit board traces by soldering thereto.

The ground spring clip 68 comprises a planar base 72 from which extend a pair of opposed cantilever beam spring arms 74 and clinching tabs 76. Thelbase 72 is mounted on the printed circuit board (PCB) 62' on the sensor side (opposed to the side on which the capacitors 65 are mounted) and fixed thereto by clinching the tabs 76 around the edge of the printed circuit board. The spring arms 74 extend upwardly from the board and abut resiliently against the surface of the outer housing cavity 6 to interconnect the ground trace 66 to the outer housing. The sensor side of the printed circuit board is covered with a conductive ground trace 67 (as shown in FIG. 2) over substantially the whole surface of the PCB except around the receptacle contacts 54 to avoid electrical contact therewith. An effective shield is thus provided between the sensor and the cable section of the connector to minimize electrostatic and electromagnetic noise generated by, for example spark ignition affecting the signals carried by the leads 18. Noise reduction is further enhanced by filtering the signals with the capacitors 65.

Figure 6:
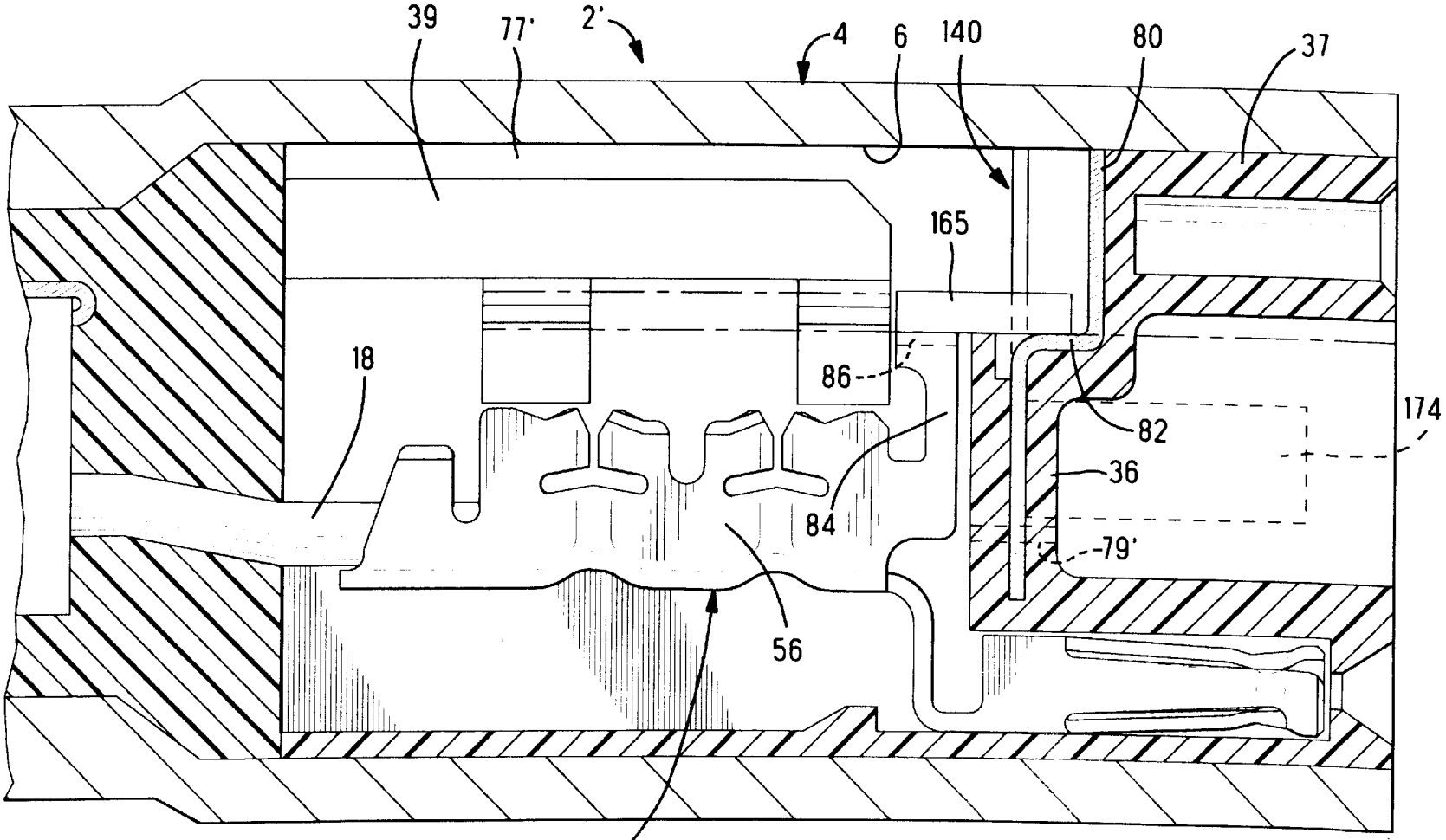
FIG. 6 is a cross-sectional view through another embodiment of this invention.

Referring now to FIG. 6 another sensor connector embodiment 2' is shown, having many similar features to the embodiment of FIG. 1 which will therefore not be redescribed. The main difference between the embodiment of FIG. 6 and that of FIG. 1 relates to the shield member which will now be described in detail. Identical features of the embodiment 2' with the embodiment 2 will be denoted with the same number, and similar but slightly different features will have the same numbering with a prime.

The sensor connector 2' comprises a stamped and formed shield member 140 that extends transversely across the outer housing cavity 6 thereby separating the inner housing sensor section and cable sections 37,39 respectively. The shield element 140 is overmoulded by the insulative housing 36, but it would be conceivable to simply mount it in a slot of the housing provided therefor. The former design however provides more resistance to shock. The shield 140 is substantially planar but has tabs 80 stamped to an offset plane therefrom, thereby forming a shoulder 82 for attachment of a ground pole of a capacitor 165, for example by soldering therewith. The other pole of the capacitor 165 is electrically connected to the terminal 38 which comprises a pair of resilient cantilever beam spring arms 84 for receiving (i.e. clipping onto) a contact 86 of the capacitor 165. The spring arms allow provisional mounting of the capacitor 165 to the terminal and against the shield shoulder 82, but a more robust and vibration resistant fixing is achieved by soldering the connections between the capacitor, and the shield and terminal respectively.

The stamped and formed shield is a very cost-effective solution of effective shielding. Grounding of the shield 140 to the outer housing 4 can be made by providing resilient contact arms 174 extending from the shield member in a similar manner to the contact arms 74 that extend from the spring clip 68 of the embodiment of FIGS. 1–5. It should be noted that the contact arms 84 of the terminal 38 for connection to the capacitor 165 extend from the IDC connection section 56 to a sufficient distance away therefrom to prevent, on the one hand solder from flowing into the IDC portions, and on the other hand to provide a certain flexibility between the contact portion 86 and the IDC contact sections to absorb the prising apart of the IDC slot during connection to a lead 18.

Referring to FIGS. 1, 2 and 6, both embodiments 2,2' can be provided with small holes 79,79' respectively, that traverse the inner housing and shield member to provide access to a cavity area 77,77' between the shield member and cable for injecting this remaining cavity area with a hardenable liquid material such as a silicon rubber, or melted plastic. Once the connector 2,2' is assembled, a needle for injecting the fluid can be inserted through the hole 79,79', and liquid is injected until the cavity area 77,77' is filled up to the shield member. Hardening of this material would provide an extremely robust and reliable retention of the connection between the lead and terminal, and between the elements sold to the PCB which could, in particular, withstand the high shocks generated by combustion. After injection of the hardenable fluid, the sensor can be mounted to the connector.

Advantageously therefore, transverse extension of shielding across the sensor connector separating the sensor from the leads reduces transmission of electromagnetic noise to the leads. Furthermore, integral moulding of conductive material around the cable end on the one hand reduces any play, and on the other hand provides a reliable ground connection of the cable shielding. Extension of an outer housing along a certain length of the cable as well as provision of a tubular member therebetween provides sealing as well as strong strain relief of the cable with respect to tensile and bending forces. Extension of the terminal receiving housing from a sensor end to abutment with cable end overmoulding eliminates play therebetween and thus enhances resistance to shock. Soldering of capacitors between the shielding and terminals also removes and play and increases resistance to shock generated by the combustion. Filling of the cavity area around the terminal connection section between the cable and the shield member substantially increases resistance to shock and ensure a reliable connection.

We claim:

1. A sensor connector comprising an outer housing securely fixable to a sensor, the outer housing having a cavity extending therethrough for receiving a shielded sensor cable therein at one end and contacts of the sensor at the other end the connector further comprising a connection section mounted in the outer housing for interconnecting leads of the cable to the sensor contacts characterized in that the connection section comprises an insulative housing and terminals for connection to the leads, and a conductive shield member mounted transverse to the passage of the outer housing cavity to extend substantially fully across the cavity except for around the terminals which project through the shield member.

2. The connector of claim 1 wherein the outer housing extends over a length of the sensor cable and there is a strain relief member disposed around the cable along this length for retaining the cable to the outer housing in opposition to tensile forces therealong.

3. The connector of claim 2 wherein part of the strain relief member is a tubular member inserted between the cable and outer housing, the member comprising circumferential protrusions disposed therearound for sealing.

4. The connector of claim 2 wherein the strain relief member is an elastomeric or plastic overmoulding, and extends along the cable beyond a cable receiving end of the outer housing to provide protection against overbending of the cable at the cable exit from the outer housing.

5. The connector of claim 1 wherein the connector comprises a conductive plastic or elastomeric overmoulding moulded around an end of the cable and extending to the outer housing for electrically interconnecting shielding of the cable to the outer housing, and as a strain relief means for retaining the cable in the outer housing.

6. The connector of claim 1 wherein the insulative inner housing extends from abutment with a cable end member to a sensor mating end for removing all play therebetween.

7. The connector of claim 1 wherein the inner housing comprises a sensor section having a plurality of cavities for receiving receptacle contacts of the terminals therein, whereby the sensor section is arranged on a side of the shield member that is adjacent the sensor.

8. The connector of claim 7 wherein the terminals comprise insulation displacement contact (IDC) sections for connection to the leads, the IDC sections being disposed on a cable side of the shield member, remote from the sensor.

9. The connector of claim 1 wherein the terminals are stamped and formed from sheet metal and comprise a connection section for connection to the leads, and a receptacle contact section for contacting the sensor contacts, the contact and connection sections being joined by a transition section comprising an integral thin strip that has a section disposed proximate the outer housing to enable the shield to extend across the cavity as far as possible for effective shielding of the leads from the sensor.

10. The connector of claim 1 wherein the terminals comprise extensions for connection to filter elements, which are connected to the shield member.

11. The connector of claim 1 wherein the shield member is a printed circuit board (PCB) having a conductive ground trace thereacross for connection to ground, the ground trace providing the shielding.

12. The connector of claim 11 wherein the PCB has conductive circuit traces thereon for interconnecting the terminals to filter elements such as capacitors, the other pole of the filter elements being connected to the ground trace.

13. The connector of claim 12 wherein the filter elements are soldered to the PCB traces, and the terminal extensions abut the PCB and are also soldered to the circuit traces.

14. The connector of claim 11 wherein a stamped and formed grounding clip is attached to the PCB and electrically connected to the ground trace, the clip comprising resilient contact arms extending therefrom and resiliently biased against the outer housing for electrical contact therewith.

15. The connector of claim 14 wherein the grounding clip is fixed to the PCB by tabs thereof clinched over edges of the PCB.

16. The connector of claim 1 wherein the shield member is stamped and formed from sheet metal.

17. The connector of claim 16 wherein the shield member has a substantially planar shield except for tabs bent therefrom to provide connection surfaces for connection of filter elements thereto.

18. The connector of claim 16 wherein the shield member is attached to the inner housing by moulding the housing over portions of the shield member.

19. The connector of claim 16 wherein the filter elements are soldered to the shield member and to the terminal extensions.

20. The connector of claim 16 wherein the shield member comprises spring contact arms extending therefrom and resiliently biased against the outer housing for electrical connection thereto.

21. The connector of claim 1 wherein a hole is provided through the inner housing and shield member for injection of a hardenable fluid within a cavity area surrounding the terminal connection section.

22. The connector of claim 1 wherein a cavity area surrounding the terminal connection section between the cable and the shield member is filled with a hardened material injected therein, for secure shock-resistant retention of the terminals, shield member and leads.

23. The connector of claim 9 wherein the transition section is bent transversely to absorb thermal movements in the longitudinal direction of the connector.

* * * * *